US006925772B1

(12) United States Patent
Iwakawa

(10) Patent No.: US 6,925,772 B1
(45) Date of Patent: Aug. 9, 2005

(54) EARTHQUAKE-PROOFING REINFORCING METAL FITTING

(75) Inventor: Toru Iwakawa, Tokyo (JP)

(73) Assignee: Nippon Eisei Center Co., Ltd., Tokyo (JP)

( * ) Notice: Subject to any disclaimer, the term of this patent is extended or adjusted under 35 U.S.C. 154(b) by 0 days.

(21) Appl. No.: 10/473,051

(22) PCT Filed: Jan. 25, 2000

(86) PCT No.: PCT/JP00/00362

§ 371 (c)(1),
(2), (4) Date: Sep. 14, 2001

(87) PCT Pub. No.: WO01/55521

PCT Pub. Date: Aug. 2, 2001

(51) Int. Cl.[7] ..... E04B 1/38
(52) U.S. Cl. ..... 52/713; 52/167.1; 52/236.9; 52/699
(58) Field of Search ..... 52/713, 712, 167.1, 52/1, 235, 698, 699, 703, 702, 236.9, 573.1, 52/93.1, 282.3, 282.4, 263

(56) References Cited

U.S. PATENT DOCUMENTS 3,791,074 A * 2/1974 Waffenschmidt ..... 49/399

* cited by examiner

*Primary Examiner*—Naoko Slack
(74) *Attorney, Agent, or Firm*—Sughrue Mion, PLLC

(57) ABSTRACT

A reinforcing holder against vibrations for mounting on orthogonally joined architectural structural members for a wooden building so it can withstand vibrations from an earthquake. The reinforcing holder comprises a first reinforcing base member 1 which is formed on a steel plate bent by 90° and secured to a first architectural structural member and a second reinforcing member 2 formed of a steel plate bent by 90° which is arranged symmetrically with the first reinforcing base member 1 through a hinge 4 and secured to a second architectural structural member. The second reinforcing base member has absorbing members 3, each having rubber elasticity and being mounted at plurality of locations thereof, for securing to the second architectural structural member with the absorbing members 3 interposed.

10 Claims, 5 Drawing Sheets

EARTHQUAKE-PROOFING REINFORCING METAL FITTING

TECHNICAL FIELD

The present invention relates to a reinforcing holder against vibrations mounted on the joining part of structural members such as foundations, columns, beams, cross-beams or the like to reinforce them so that a wooden building may not be broken down even if strong vibrations are loaded thereupon by an earthquake, a typhoon or the like.

BACKGROUND ART

So far, as methods for reinforcing the joining parts of structural members of a wooden buildings, there have been various methods employed: providing bracings or horizontal braces or mounting clamps or L-shaped metal fittings.

However, in such conventional methods as described above, no sufficient reinforcing effect can be obtained in a case where strong vibrations are loaded by an earthquake, a typhoon or the like, and the structural members tend to be easily disjoined or sustain damage in the joining parts so that wooden buildings sometime may be broken in the joining parts, or in a severe case, such buildings may fall down.

In view of the foregoing, the reinforcing holder against vibrations 61 shown in a perspective view of FIG. 5 has been devised and used in order to sufficiently withstand even strong vibrations caused by an earthquake, a typhoon or the like.

The reinforcing holder against vibrations 61 comprises an L-shaped base member 62 formed by bending a plate formed of high tension steel in the shape of an L and formed with bent and swelled parts 63*a* and 63*b* bent inward in intermediate parts of both pieces 62*a* and 62*b*, a reinforcing member 64 formed by bending a plate formed of high tension steel and fixedly mounted by welding on a bent corner part 62*c* of the L-shaped base member 62, and absorbing members 65 formed of shock-absorbing rubber or the like stopped at several locations of the L-shaped base member 62.

According to the above-described arrangement, both strong vertical and horizontal vibrations can be absorbed by the whole L-shaped member 62 and its bent and swelled parts 63*a* and 63*b*, and deformation of the L-shaped base member 62 can be removed and the original shape thereof can be restored. Therefore, even if strong vibrations are loaded, a wooden building does not easily break in the joining parts or fall down.

However, the above-described reinforcing holder against vibrations 61 is provided with the L-shaped base member 62 both piece parts of which are intended to join architectural structural members disposed orthogonally for its structural reasons and does not have such a function as to join architectural structural members three-dimensionally.

Further, since the reinforcing member 64 is fixedly mounted by welding on the L-shaped base member 62, and the bent corner part 62*c* of the L-shaped base member 62 and the bent corner part 64*c* of the reinforcing member 64 are placed in close contact, the amount of elastic deformation is small and the effect of removing the deformation of the L-shaped base member 62 and restoring the original shape thereof is also insufficient.

DISCLOSURE OF INVENTION

The present invention has been accomplished in order to solve such problems noted above with respect to prior art. It is an object of the present invention to provide a reinforcing holder against vibrations which can absorb vertical and horizontal vibrations and vertical oscillations so that a wooden building may not be broken down even if strong vibrations are loaded by an earthquake, a typhoon or the like, and the vibration-proof performance of which is much more enhanced, with a reinforcing base member being fixed over to architectural structural members disposed orthogonally.

The present invention is to solve the above-described problem to achieve the object thereof, and provides a reinforcing holder against vibrations for joining architectural structural members disposed orthogonally, comprising a first reinforcing base member which is formed of a plate bent by 90° and secured to one architectural structural member, and a second reinforcing base member which is arranged symmetrically with the first reinforcing base member through a hinge and secured to another architectural structural member, characterized in that the said second reinforcing base member is formed of a plate bent by 90° and absorbing members having rubber elasticity are mounted at a plurality of locations thereof, being secured to another architectural structural member through the absorbing members, and another architectural structural member is joined to one architectural structural member.

An intermediate part of the second reinforcing base member is curved outward to form a curved and swelled parts or the intermediate part is bent twice outward to form a bent and swelled parts.

It is more preferable that the plate is formed of high tension steel since it is excellent in tensile strength, weldability, notch toughness, workability and corrosion resistance.

BEST MODE FOR CARRYING OUT THE INVENTION

Preferred embodiments of the reinforcing holder against vibrations according to the present invention will be concretely described hereinafter with reference to the drawings.

Figure 1:
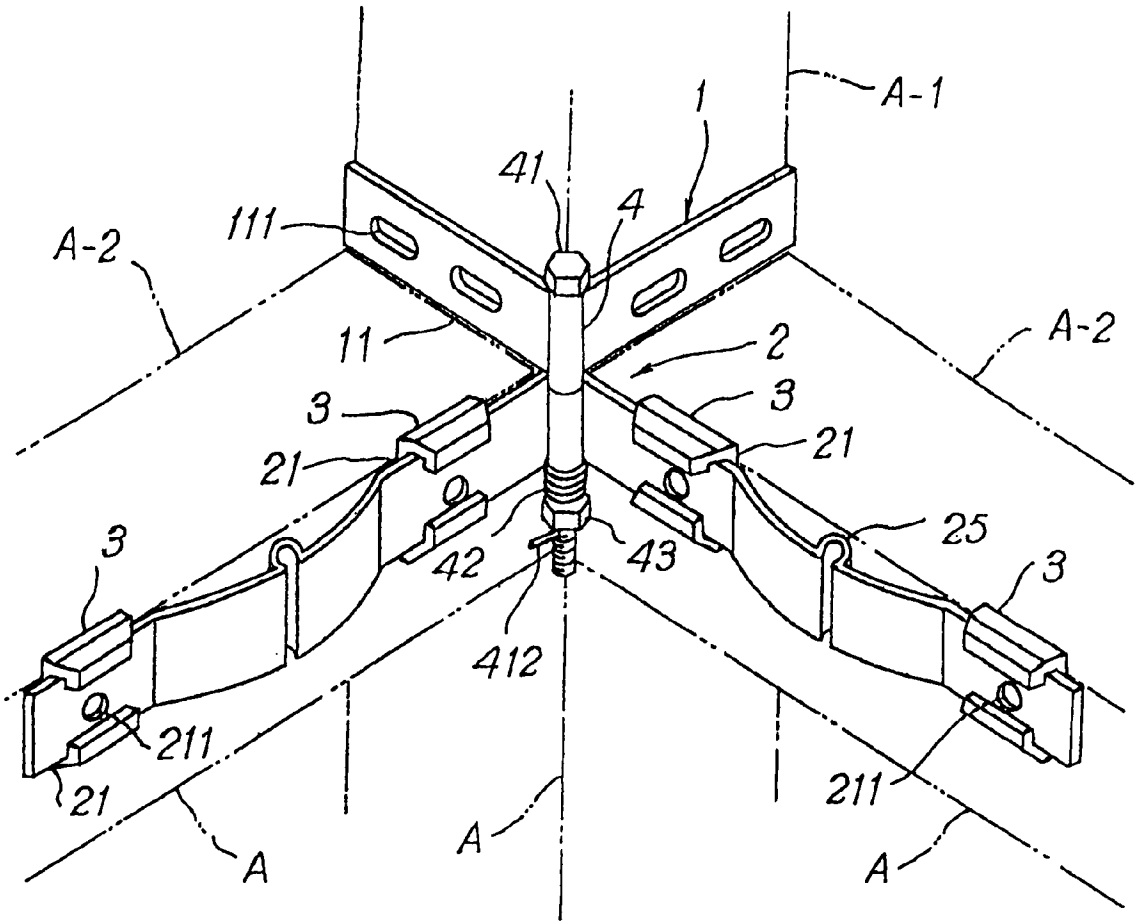
FIG. 1 is a perspective view of a mounting state in one embodiment according to the present invention.
Figure 2:
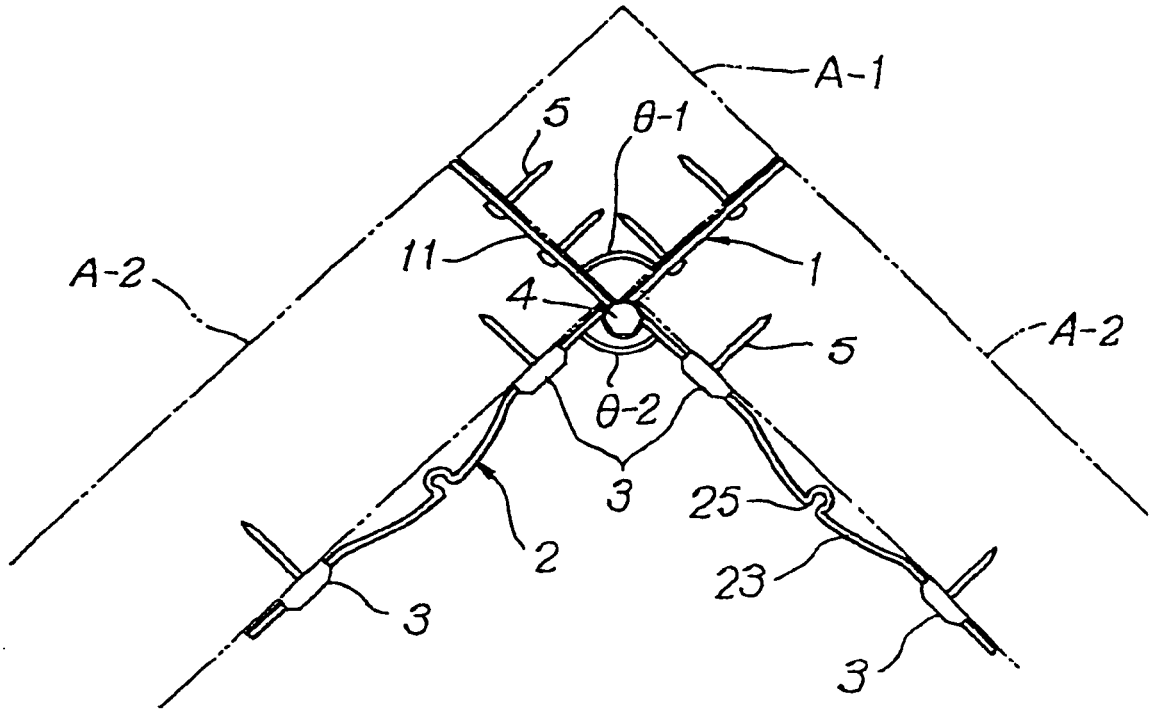
FIG. 2 is a plan view of a mounting state in one embodiment according to the present invention.

FIG. 1 is a perspective view of a mounting state in one embodiment according to the present invention; FIG. 2 is a plan view of a mounting state in one embodiment according to the present invention, FIG. 3 is an exploded perspective view of various members used in one embodiment according to the present invention, and FIG. 4 is a perspective view of another embodiment according to the present invention.

Figure 3:
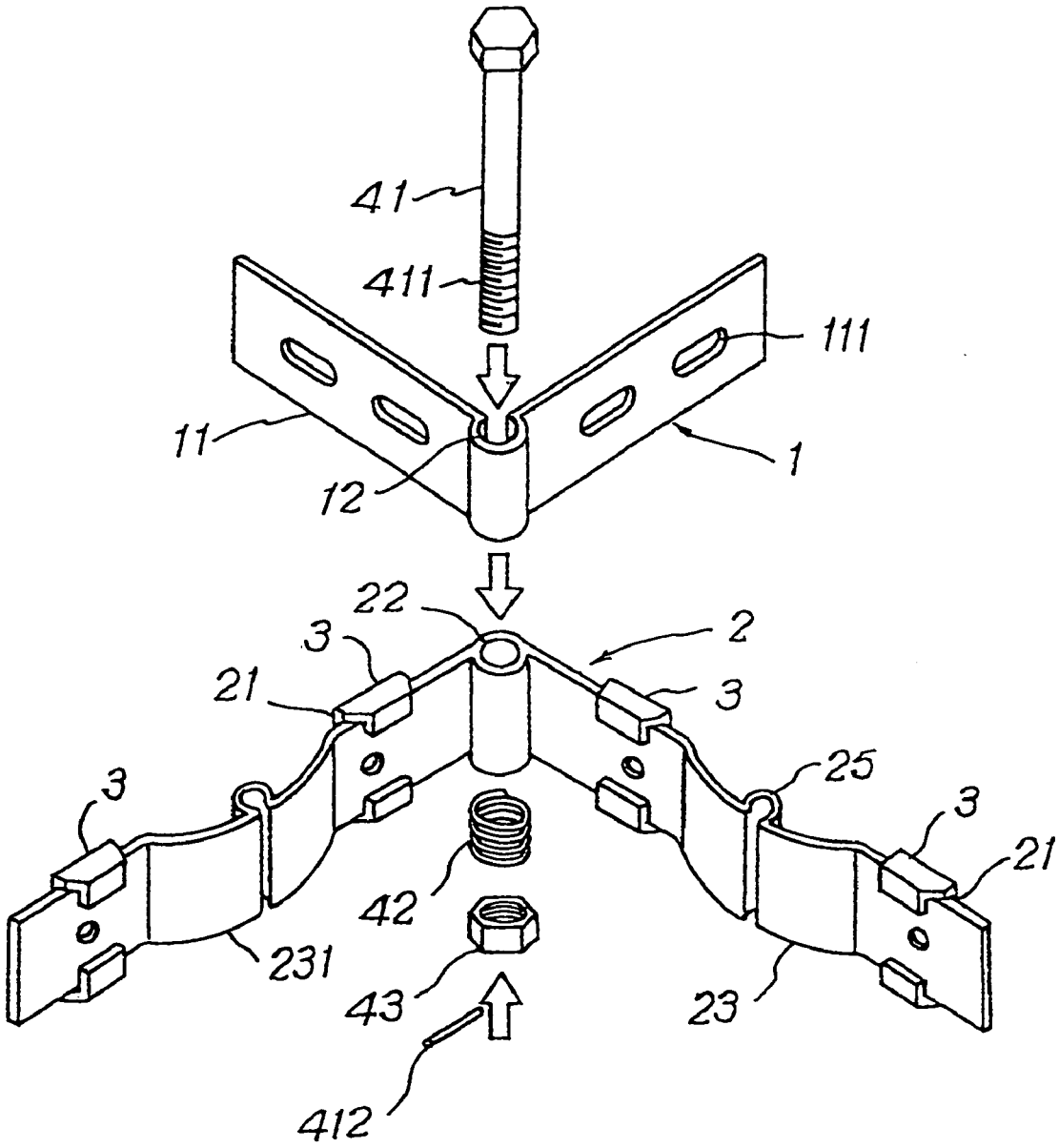
FIG. 3 is an exploded perspective view of various members used in one embodiment according to the present invention.
Figure 4:
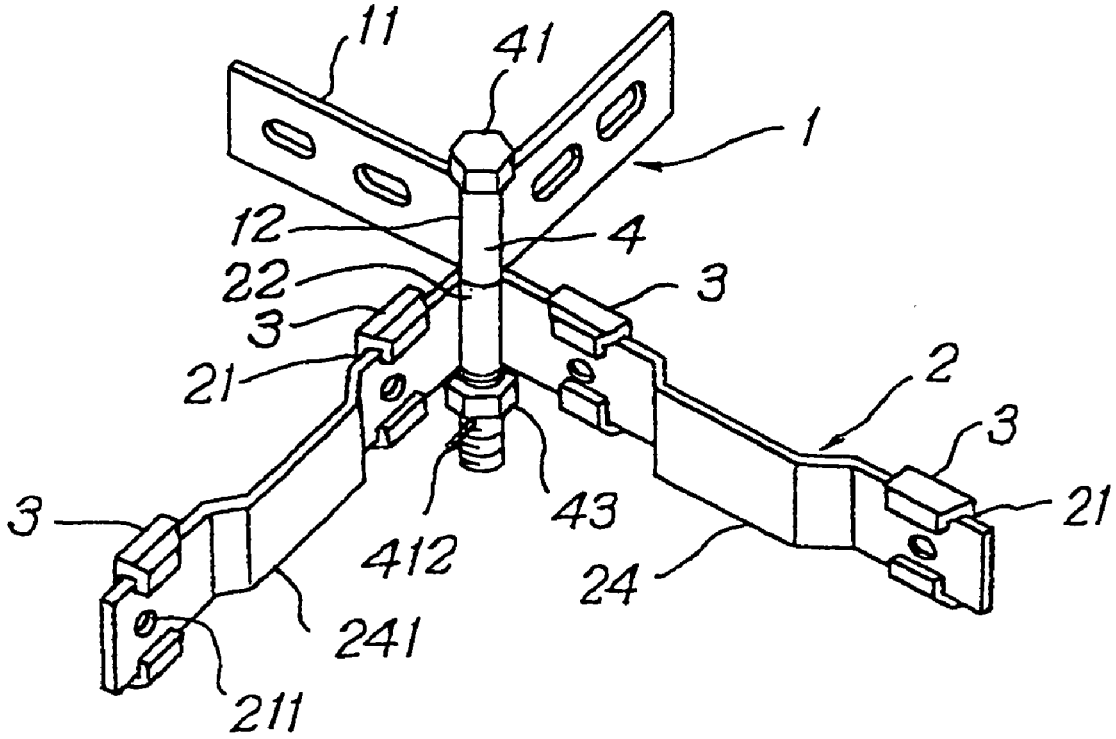
FIG. 4 is a perspective view of another embodiment according to the present invention.
Figure 5:
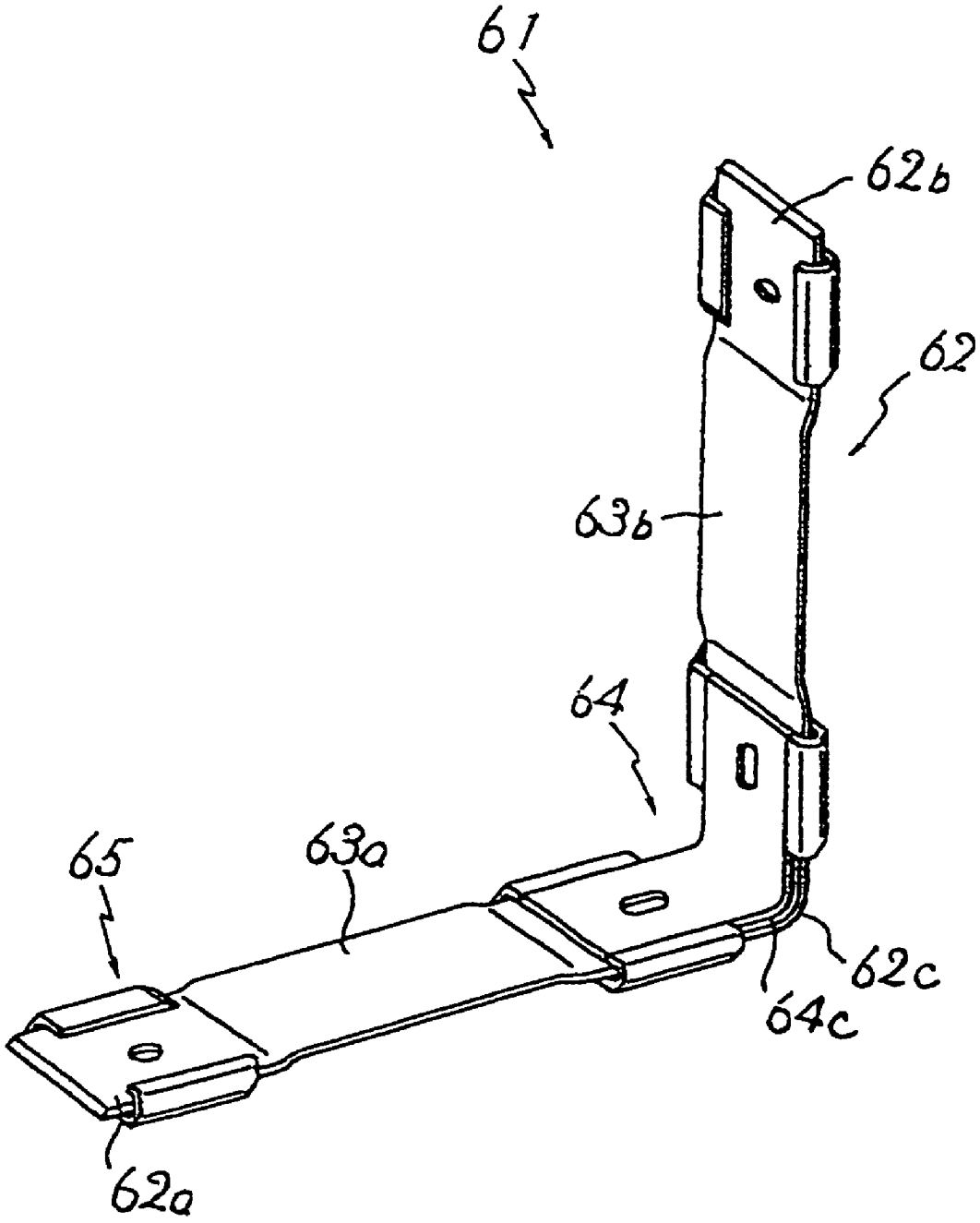
FIG. 5 is a perspective view of a conventional reinforcing holder against vibrations.

As shown in the perspective views of FIGS. 1, 3, and 4, and the plan view of FIG. 2, the present invention provides the reinforcing holder against vibrations for joining architectural structural members A and A disposed orthogonally, comprising a first reinforcing base member which is formed of a plate bent by 90° and secured to one architectural structural member, and a second reinforcing base member which is arranged symmetrically with the first reinforcing base member through a hinge and secured to another architectural structural member, characterized in that the said second reinforcing base member is formed of a plate bent by 90° and absorbing members having rubber elasticity are mounted at a plurality of locations thereof, being secured to another architectural structural member through the absorbing members, and another architectural structural member is joined to one architectural structural member.

Further intermediate parts of the second reinforcing base member 2 are curved outward to form curved and swelled parts 23 having curved faces 231, or the intermediate parts are bent twice outward to form bent and swelled parts 24 having plane faces 241. If necessary, a cushion round 25 can be formed in an approximately central part of the curved and swelled parts 23 or the bent and swelled parts 24 of the second reinforcing base member 2.

According to the present invention, the curved and swelled parts 23 or the bent and swelled parts 24 are formed outside of the intermediate parts of the second reinforcing base member 2, the absorbing members 3 having rubber elasticity are mounted at a plurality of locations of the fixed pieces 21, 21, and the second reinforcing base member 2 is vertically, resiliently and rotatably connected with the first reinforcing base member 1 by the hinge 4, wherefore vertical and horizontal vibrations and vertical oscillation are absorbed and the restoring force is produced, thus the resistance force against inclinations or torsions is increased even if strong vibrations are loaded on a wooden building by an earthquake, a typhoon or the like. Further, if necessary, the cushion round 25 is formed in an approximately central part of the intermediate parts of the curved and swelled parts 23 or bent and swelled parts 24, whereby the absorbing effect can be further enhanced.

As shown in FIGS. 1, 2, and 4, the present invention provides a reinforcing holder against vibrations provided extending over, for example, a column member A-1 and a beam or a cross-beam member A-2 of the architectural structural member A, comprising the first reinforcing base member 1 secured to the column member A-1 and the second reinforcing base member 2 arranged symmetrically with the first reinforcing base member 1 through the hinge 4 and secured to a beam or cross-beam member A-2.

In the first reinforcing base member 1, a plate formed of iron and steel material having both flexibility and rigidity is bent so that a bent angle θ-1 is 90° and both pieces of the first reinforcing base member 1 are formed into fixed parts 11 and 11 to be fixed along the surface of the column member A-1 and each of the fixed parts is bored with a slot 111, and a Ω-like loop shaft support part 12 is formed at the bent corner part. Though not shown, a tubular shaft support part may be provided in place of the loop shaft support part 12.

In the second reinforcing base member 2, a plate formed of iron and steel material having both flexibility and rigidity is bent so that a bent angle θ-2 is 90°, on the bent corner part of which is provided a tubular shaft support part 22, both pieces of which are formed into fixed pieces 21 and 21 to be fixed to the beam or the cross-beam member A-2, and an intermediate part of each of the fixed pieces 21 and 21 is curved outward to form a curved and swelled part 23 having a curved face 231, or an intermediate part of the fixed pieces 21 and 21 is bent twice outward to form a bent and swelled part 24 having a plane face 241. If necessary, the cushion round 25 is formed in an approximately central part of the curved and swelled part 23 or the bent and swelled parts 24.

Further, a plurality of locations of the fixed pieces 21 and 21 of the second reinforcing base member 2 are bored with fixed holes 211, respectively, and an absorbing member 3 having rubber elasticity is mounted adjusting to the position of the fixed hole 211.

The absorbing members 3 mounted on the fixed pieces 21 and 21 of the second reinforcing base member 2 is formed of shock-absorbing rubber having rubber elasticity with excellent elastic characteristics and durability, the contact surface in contact with an architectural structural member A on the back side thereof is bored with slots adjusting to the fixed holes 211 bored at a plurality of locations of the fixed pieces 21 and 21 of the second reinforcing base member 2, enabling fine adjustment of the position of the second reinforcing base member 2 mounted, and on the surface side thereof is formed with an embracing piece for embracing the fixed piece 21 of the second reinforcing base member 2.

Preferably, construction steel is employed for the iron and steel material described above, and, more preferably, high tension steel is employed. High tension steel is obtained by adding to low carbon steel a small quantity of a suitable combination of alloy elements such as manganese, silicone, nickel, chrome, molybdenum or the like, and generally has tensile strength of not less than 50 kg/mm$^2$ and yield point of not less than 30 kg/mm$^2$ and is excellent in weldability, notch toughness, workability and corrosion resistance.

The hinge 4 for resiliently shaft support-connecting the first reinforcing base member 1 and the second reinforcing base member 2 in a vertical direction is then formed, as shown in FIG. 3, by loosely fitting a shaft center bolt 41 in the direction of the arrow from the Ω-like loop shaft support part 12 formed at the bent corner part of the first reinforcing base member 1 to the tubular shaft support part 22 formed at the bent corner part of the second reinforcing base member 2, screw-mounting a nut 43 on the shaft center bolt 41 projecting from the bottom of the tubular shaft support part 22 through a spring 42, and insert-mounting a stopper pin 412 into a pin hole 411 bored in the lower part of the shaft center bolt 41 directly under the nut 43.

The procedure for mounting the reinforcing holder against vibrations of the present invention on the architectural structural member A will be described hereinafter.

As shown in FIGS. 2 and 3, first, the fixed part 11 of the first reinforcing base member 1 is temporarily fixed to the column member A-1 using a fixing part 5 such as screws or nails through the slot 111, after which the tubular shaft support part 22 of the fixed piece 21 of the second reinforcing base member 2 is adjusted to the loop shaft support part 12 of the first reinforcing base member 1 and the shaft center bolt 41 is loosely fitted, the nut 43 is screw-mounted through the spring 42 on the shaft center bolt 41 projecting from the bottom of the tubular shaft support part 22, and the stopper pin 412 is insert-mounted into the pin hole 411.

Thereafter, the fixed piece 21 of the second reinforcing base member 21 is secured to the beam or the cross-beam member A-2 using the fixing part 5 through the fixed hole 211 and the slot of the absorbing member 3, and, at the same time, the fixing part 5 temporarily secured to the column member A-1 is firmly fixed to complete the mounting work for the reinforcing holder against vibrations of the present invention to the architectural structural member A.

According to the present invention, the vertical vibrations between the first reinforcing base member 1 secured to the column member A-1 and the second reinforcing base member 2 secured to the beam or the cross-beam member A-2 are absorbed by the hinge 4 for resiliently shaft support connecting in a vertical direction through the spring 42, and in the second reinforcing base member 2, the curved and swelled part 23 or the bent and swelled part 24 and the cushion round 25 are formed and conjointly therewith, and the fixed piece 21 is secured to the beam or the cross-beam member A-2 through the absorbing member 3 having rubber elasticity, whereby the horizontal vibrations are absorbed and the restoring force is provided. After all, even if strong vibrations are loaded vertically or horizontally on a wooden building by an earthquake, a typhoon or the like, the resistance force against inclinations or torsions can be increased.

Since the reinforcing holder against vibrations of the present invention is constituted as described above, the following effect is obtained.

That is, according to the present invention, the vertical or horizontal vibrations and vertical oscillations applied to the architectural structural member are absorbed and the restoring force is amplified, thus providing the operation and effect that even if the strong vibrations are loaded on a wooden building by an earthquake or the like, the resistance force is increased to further enhance the vibration-proof performance.

What is claimed is:

1. A reinforcing holder against vibration for joining architectural structural members disposed orthogonally comprising:

a first reinforcing base member formed of a plate bent by 90° and adapted to be secured to one architectural structural member; and a second reinforcing base member arranged symmetrically with the first reinforcing base member and adapted to be secured to another architectural structural member;

a hinge joining said first reinforcing base member to said second reinforcing base member;

characterized in that the second reinforcing base member is so designed that the plate is bent by 90° and absorbing members having rubber elasticity are mounted at a plurality of locations thereof, said second reinforcing base member being adapted to be secured to another architectural structural member with the absorbing members interposed, whereby the said another architectural member can be joined to the said one architectural structural member.

2. The reinforcing holder as recited in claim 1 wherein an intermediate part of the second reinforcing base member is curved outward to form a curved and swelled part.

3. The reinforcing holder as recited in claim 2 wherein the said plate is formed of high tension steel.

4. The reinforcing holder as recited in claim 1 wherein an intermediate part of the second reinforcing base member is bent twice outward to form a bent and swelled part having a plane surface.

5. The reinforcing holder as recited in claim 4 wherein the said plate is formed of high tension steel.

6. The reinforcing holder as recited in claim 1 wherein the said plate is formed of high tension steel.

7. A reinforcing holder against vibration for joining architectural structural members disposed orthogonally comprising:

a first reinforcing base member formed of a plate bent by 90° and defining an interior angle plate surface having a bent part, said interior angle plate surface being adapted for securing to a first architectural structural member; and a second reinforcing base member formed of a plate bent by 90° and defining an exterior angle plate surface having a bent part, said exterior angle plate surface being adapted to be secured against a surface of a second architectural structural member; and a hinge joining said first reinforcing base member to said second reinforcing base member such that said second reinforcing base member is arranged symmetrically with respect to the first reinforcing base member;

wherein the second reinforcing base member comprises a plurality of absorbing members having rubber elasticity mounted at a plurality of locations thereof and being adapted to be interposed between said exterior angle plate surface and said second architectural structural member.

8. The reinforcing holder as recited in claim 7 wherein said hinge joining said first reinforcing base member and second reinforcing base member comprises a pin extending along said bent part of said first reinforcing base member and said bent part of said second reinforcing base member.

9. The reinforcing holder according to claim 7 wherein said hinge at said bent part of at least one of said first reinforcing base member and second reinforcing base member comprises an Ω-like loop shaft support part.

10. The reinforcing holder as recited in claim 7 wherein said hinge at said bent part of at least one of said first reinforcing base member and second reinforcing base member comprises a tubular shaft support part.

* * * * *